US011186977B2

(12) United States Patent
Lorkowski et al.

(10) Patent No.: US 11,186,977 B2
(45) Date of Patent: Nov. 30, 2021

(54) CLOSET FLANGE WITH BOLT SUPPORT

(71) Applicant: Oatey Co., Cleveland, OH (US)

(72) Inventors: Aaron Lorkowski, North Ridgeville, OH (US); Jeffrey Zhang, Cleveland Heights, OH (US); Kenneth Brown, Columbia Station, OH (US)

(73) Assignee: OATEY CO., Cleveland, OH (US)

( * ) Notice: Subject to any disclaimer, the term of this patent is extended or adjusted under 35 U.S.C. 154(b) by 0 days.

(21) Appl. No.: 16/738,846

(22) Filed: Jan. 9, 2020

(65) Prior Publication Data

US 2020/0224401 A1 Jul. 16, 2020

Related U.S. Application Data

(60) Provisional application No. 62/793,213, filed on Jan. 16, 2019.

(51) Int. Cl.
*E03D 11/16* (2006.01)

(52) U.S. Cl.
CPC ..... *E03D 11/16* (2013.01)

(58) Field of Classification Search
CPC ..... E03D 11/16; A47K 13/12; F16B 35/048; F16B 35/06; F16B 35/04
USPC ..... 411/107, 104
See application file for complete search history.

(56) References Cited

U.S. PATENT DOCUMENTS

| | | | | |
|---|---|---|---|---|
| 1,490,805 | A | 4/1924 | Divekey | |
| 1,684,570 | A * | 9/1928 | Boosey | E03D 11/16 285/59 |
| 2,549,357 | A * | 4/1951 | Angelone | E03D 11/16 285/413 |
| 4,648,139 | A | 3/1987 | Stokes | |
| 4,827,539 | A * | 5/1989 | Kiziah | E03D 11/16 285/303 |
| D574,931 | S | 8/2008 | Hughes | |
| 8,573,880 | B2 * | 11/2013 | Chen | F16B 12/125 403/331 |
| 9,068,678 | B2 | 6/2015 | Whitehead | |
| 9,422,704 | B2 | 8/2016 | Whitehead | |
| 10,240,331 | B1 * | 3/2019 | Condon | E03D 11/16 |
| 2003/0159204 | A1 | 8/2003 | Crowe | |
| 2016/0024775 | A1 * | 1/2016 | Wood | E03D 11/16 4/252.4 |
| 2016/0024776 | A1 | 1/2016 | Wood | |
| 2017/0016224 | A1 | 1/2017 | Wood | |

* cited by examiner

*Primary Examiner* — Janie M Loeppke
(74) *Attorney, Agent, or Firm* — BakerHostetler

(57) ABSTRACT

A closet flange configured to secure a toilet to a drain pipe. The closet flange includes a body portion and a flange portion. The flange portion extends radially outward from an upper end of the body portion. The flange portion comprises at least one slot and a shoulder. The at least one slot extends along the flange portion from a receiving end to a retaining end. The at least one slot has an opening that extends from the receiving end to the retaining end. The shoulder is positioned below the opening of the at least one slot and extends from the receiving end to the retaining end. The shoulder includes a support surface that extends at an angle offset from the upper surface of the flange portion.

17 Claims, 11 Drawing Sheets

CLOSET FLANGE WITH BOLT SUPPORT

CROSS-REFERENCE TO RELATED APPLICATIONS

This application claims the benefit of U.S. Provisional Application No. 62/793,213, filed Jan. 16, 2019, the disclosure of which is incorporated by reference herein in its entirety.

TECHNICAL FIELD

This disclosure relates generally to a closet flange assembly and, more particularly, to an assembly and method for a closet flange having bolt supports.

BACKGROUND

Installing a toilet requires the use of a closet flange to connect the base of the toilet to a drain and the sub-floor. The closet flange is generally installed by attaching the flange to the subfloor. The toilet is placed on top of and secured to the closet flange by bolts or other fasteners. The bolts are generally placed on the flange and extend upwardly to engage the toilet to securely fasten the toilet to the flange.

Current closet flange systems include a flange that defines a key slot configured to receive a bolt head within. The bolt head is supported by the subfloor below the flange so that a shaft of the bolt extends upwardly through the flange to engage the base of the toilet being connected above. In many instances, the subfloor may be curved, crooked, warped or include cracks or other flaws that make the subfloor uneven for supporting the bolt head. The uneven subfloor affects the position of the bolt, which adversely impacts the alignment of the bolt with the base of the toilet.

Therefore, there is a need for a closet flange assembly capable of supporting and aligning fasteners for coupling to and securing a toilet during installation.

The foregoing background discussion is intended solely to aid the reader. It is not intended to limit the innovations described herein. Thus, the foregoing discussion should not be taken to indicate that any particular element of a prior system is unsuitable for use with the innovations described herein, nor is it intended to indicate that any element is essential in implementing the innovations described herein.

SUMMARY

The foregoing needs are met, to a great extent, by the closet flange assembly disclosed in the present application.

An aspect of the present disclosure provides a closet flange that comprises a body portion and a flange portion. The body portion has an upper end and a lower end spaced apart from the upper end. The flange portion extends radially outward from the upper end of the body portion. The flange portion comprises at least one slot and a shoulder. The at least one slot extends along the flange portion from a receiving end to a retaining end. The at least one slot has an opening defined by an upper surface of the flange portion. The opening extends from the receiving end to the retaining end. The shoulder is positioned below the opening of the at least one slot and extends below the at least one slot from the receiving end to the retaining end.

The shoulder includes a support surface configured to support a bolt thereon such that a shaft of the bolt extends through the opening of the at least one slot. The support surface extends at an angle offset from the upper surface of the flange portion, such that a distance from the support surface to the opening at the receiving end of the at least one slot is greater than a distance from the support surface to the opening at the retaining end of the at least one slot.

An aspect of the present disclosure provides a closet flange that comprises a flange portion and a shoulder. The flange portion extends about a substantially circular opening and includes an upper surface, a lower surface opposing the upper surface in an axial direction, at least one slot, an inner edge defining the circular opening, and an outer edge spaced apart from the inner edge in a radial direction. The radial direction is substantially perpendicular to the axial direction. The at least one slot is positioned between the inner edge and the outer edge. The at least one slot extends through the flange portion from the upper surface to the lower surface, and further extends along the flange portion from a receiving end to a retaining end. The shoulder is positioned below the at least one slot in the axial direction. The shoulder extends below the at least one slot from the receiving end to the retaining end.

The shoulder includes a support surface configured to support a bolt head thereon such that a shaft of the bolt head extends through the at least one slot. The shoulder is flexible in the axial direction, wherein when the bolt head is inserted into the receiving end of the at least one slot and moved toward the retaining end the shoulder flexes in the axial direction and applies a force to the bolt head in a direction opposite the axial direction that secures the bolt head between the support surface of the shoulder and the lower surface of the flange portion.

Another aspect of the present disclosure includes a method for securing a closet flange to a toilet. The method comprises: securing the closet flange to a subfloor; inserting a bolt head through the opening of the at least one slot at the receiving end such that a shaft of the bolt head extends through the opening of the at least one slot at the receiving end and the bolt head is supported by a support surface of the shoulder; moving the bolt head from the receiving end of the at least one slot to the retaining end of the at least one slot such that the shaft extends through the opening of the at least one slot at the retaining end; and securing the toilet to the shaft of the bolt head.

This summary is provided to introduce a selection of concepts in a simplified form that are further described below in the Detailed Description section. This Summary is not intended to identify key features or essential features of the claimed subject matter, nor is it intended to be used to limit the scope of the claimed subject matter. Furthermore, the claimed subject matter is not constrained to limitations that solve any or all disadvantages noted in any part of this disclosure.

BRIEF DESCRIPTION OF THE DRAWINGS

The foregoing summary, as well as the following detailed description of illustrative embodiments of the present application, will be better understood when read in conjunction with the appended drawings. For the purposes of illustrating the present application, there are shown in the drawings illustrative embodiments of the disclosure. It should be understood, however, that the application is not limited to the precise arrangements and instrumentalities shown. In the drawings.

DETAILED DESCRIPTION

Figure 1:
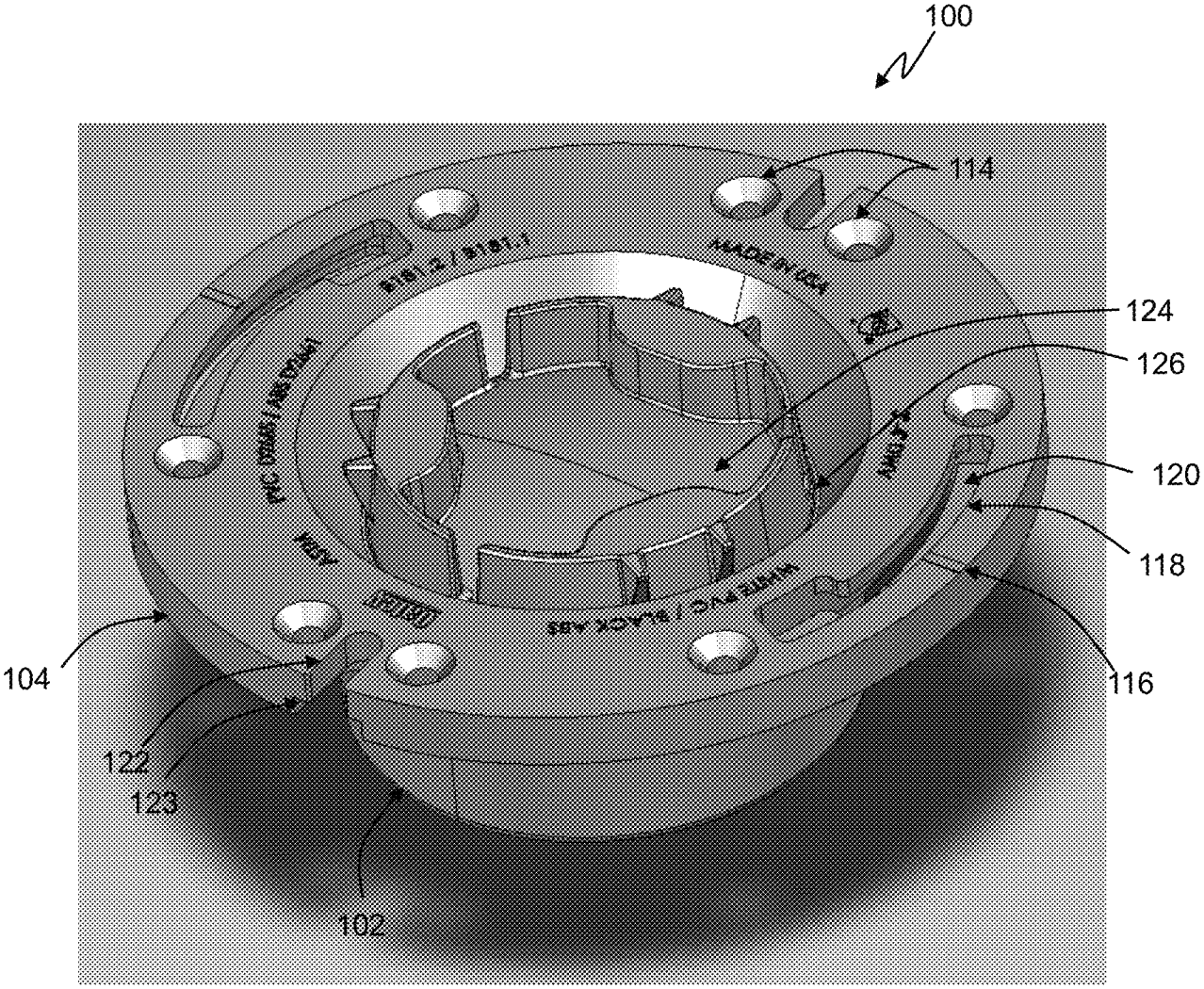
FIG. 1 is a top perspective view of a closet flange, according to a first aspect of this disclosure.

A closet flange for securing a toilet to a drain pipe is disclosed. The closet flange includes a flange portion that extends radially outward from an opening. The flange portion defines key slots that extend therethrough and that are configured to receive bolts for securing the closet flange to the toilet. The flange portion includes shoulders that are positioned beneath each of the key slots and are configured to support the bolt positioned within the respective key slot such that the bolt does not fall through the flange portion. The shoulder may be ramped between a receiving end of the key slot to a retaining end of the key slot. As the bolt is moved along the shoulder from the receiving end to the retaining end, the bolt head of the bolt is secured to the flange portion by a narrowing of a channel formed between a bottom surface of the flange portion and a top surface of the shoulder. The shoulder may also be flexible, such that when the bolt head is pressed against the shoulder, the shoulder flexes downward. As the bolt is moved toward the retaining end, the shoulder provides an upward force onto the bolt securing the bolt between the flange portion and the shoulder.

Certain terminology used in this description is for convenience only and is not limiting. The words "top", "bottom", "above", "below", "axial", "transverse", "circumferential," and "radial" designate directions in the drawings to which reference is made. The term "substantially" is intended to mean considerable in extent or largely but not necessarily wholly that which is specified. All ranges disclosed herein are inclusive of the recited endpoint and independently combinable (for example, the range of "from 2 grams to 10 grams" is inclusive of the endpoints, 2 grams and 10 grams, and all the intermediate values). The terminology includes the above-listed words, derivatives thereof and words of similar import.

Figure 2:
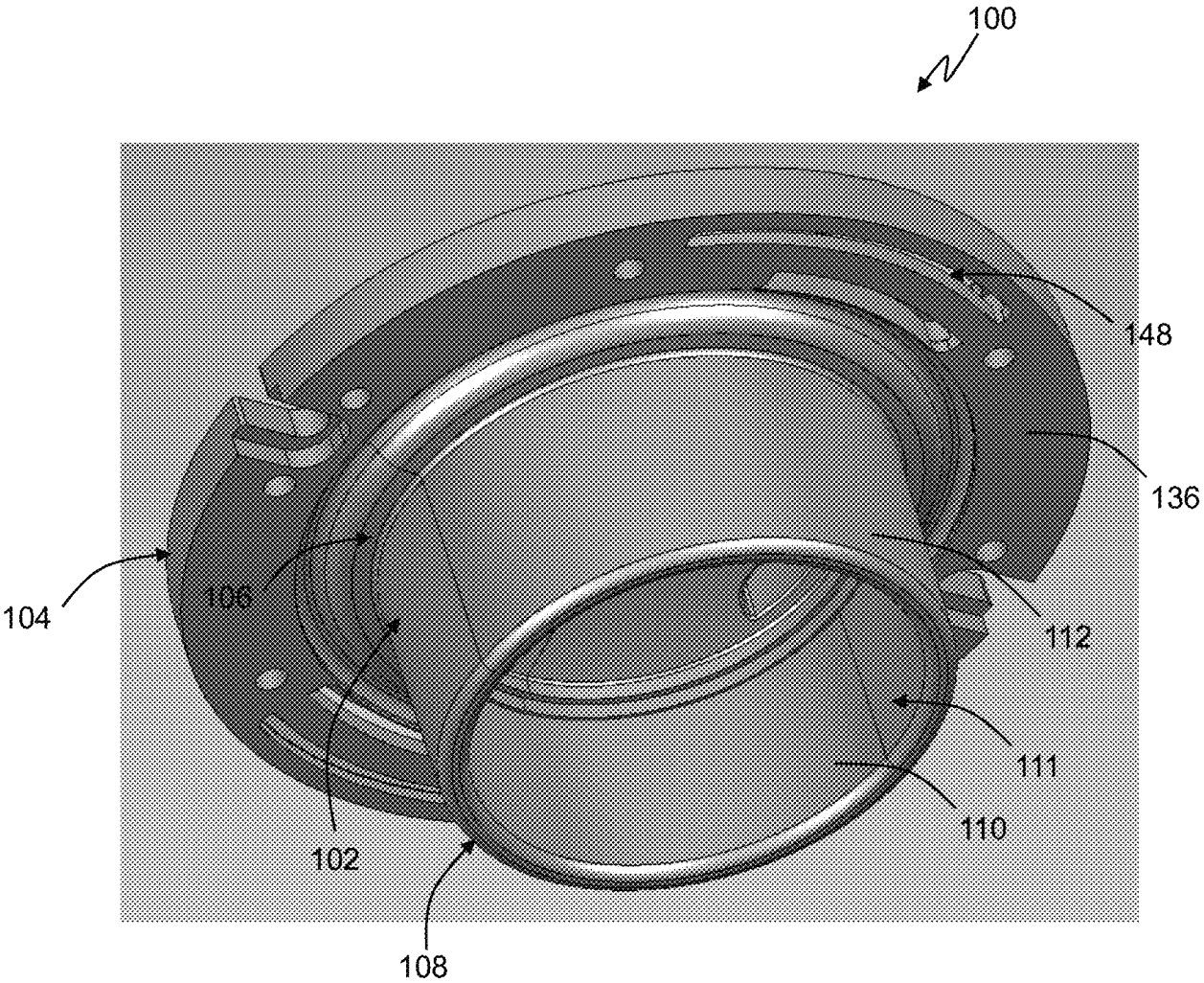
FIG. 2 is a bottom perspective view of the closet flange shown in FIG. 1, according to an aspect of this disclosure.
Figure 3:
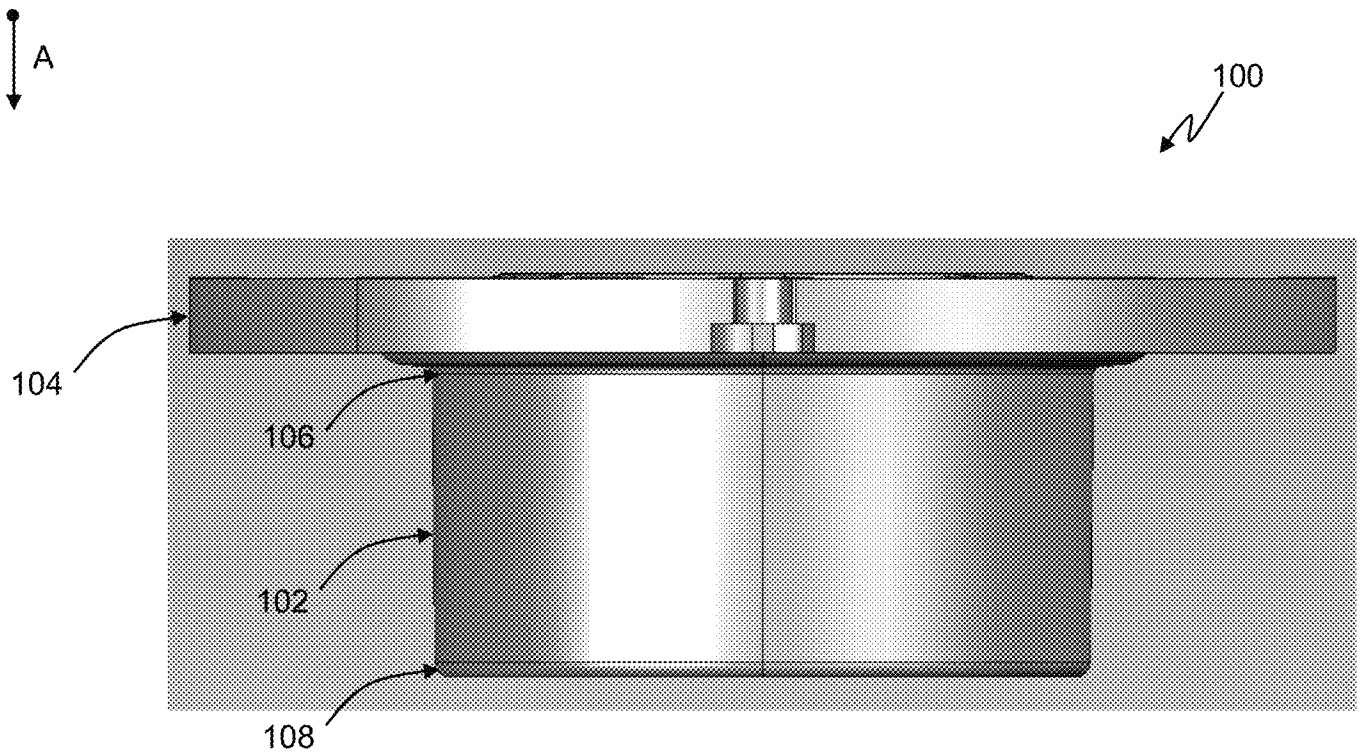
FIG. 3 is a side view of the closet flange shown in FIG. 1, according to an aspect of this disclosure.
Figure 4:
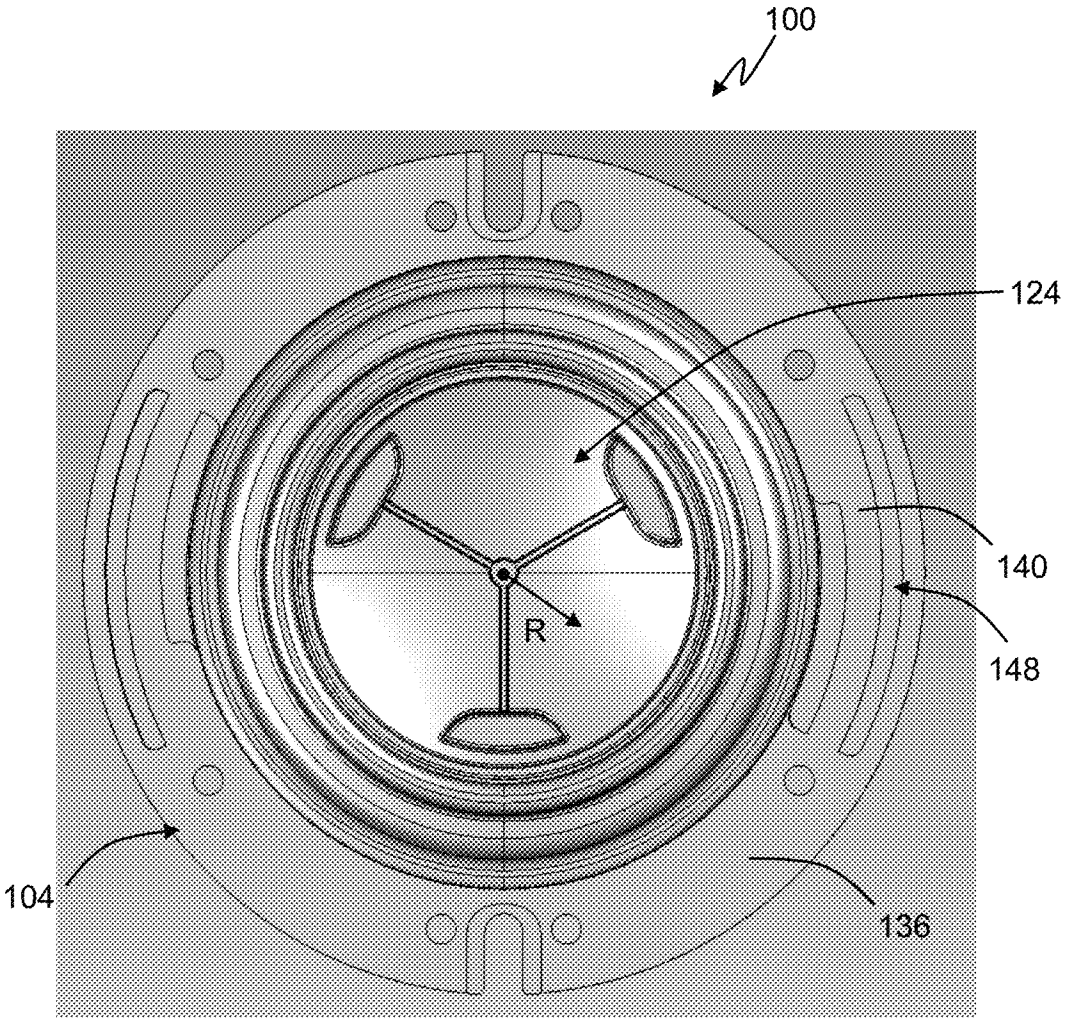
FIG. 4 is a bottom view of the closet flange shown in FIG. 1, according to an aspect of this disclosure.
Figure 5:
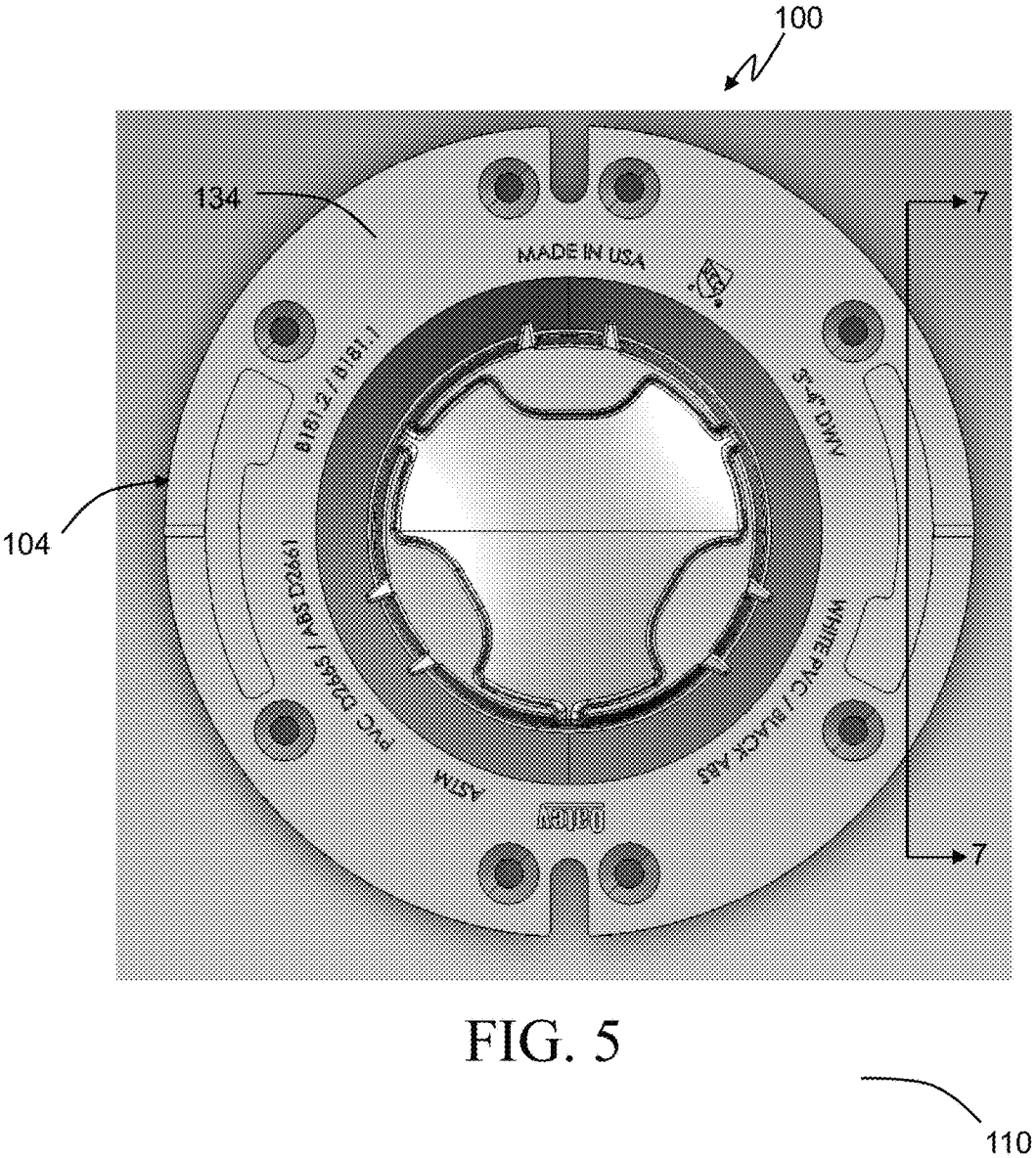
FIG. 5 is a top view of the closet flange shown in FIG. 1, according to an aspect of this disclosure.

FIGS. 1 and 2 illustrate a top perspective view and a bottom perspective view, respectively, of a closet flange 100 for securing a toilet to a drain pipe, according to an aspect of this disclosure. FIGS. 3-5 illustrate a side view, bottom view, and a top view, respectively, of the closet flange 100 illustrated in FIGS. 1 and 2, according to aspects of this disclosure.

The closet flange 100 includes a body portion 102 and a flange portion 104. The body portion 102 has an upper end 106 and a lower end 108 spaced apart from the upper end 106 in an axial direction A. The body portion 102 includes an inner body surface 110 and an outer body surface 112. The inner body surface 110 defines a bore 111 that extends through the body portion 102 from the lower end 108 to the upper end 106. The inner body surface 110 and the outer body surface 112 may both be connectable to a drain pipe of a plumping system (e.g. solvent welding if made of plastic). The flange portion 104 extends radially outward from the upper end 106 of the body portion 102. The flange portion 104 is configured to anchor the closet flange 100 both to a toilet (not shown) and to a floor or subfloor (not shown).

The flange portion 104 may be integrally formed with the body portion 102 such that the flange portion 104 and the body portion 102 form a single unitary member. In an alternative aspect, the flange portion 104 and the body portion 102 may be separate members, whereby the flange portion 104 is securable to the upper end 106 of the body portion 102. The flange portion 104 may be circumferentially movable relative to the body portion 102.

The flange portion 104 includes recessed holes 114, alignment indicators 116, slots 118 (e.g. keyed slots), a support shoulder 120, and notches 122. The recessed holes 114 are configured to receive mounting bolts for mechanically mounting the closet flange 100 to the floor. The alignment indicators 116 provide a visual indication of alignment of the closet flange 100. The notches 122 are configured to receive mounting bolts for mounting a toilet to the closet flange 100. The mounting bolts may be inserted from an outer periphery of flange portion 104 and slid radially inward such that a bolt head is positioned within a bottom portion 123 of the notch 122 and a shaft of the bolt extends upward through and above the flange portion 104. The slots 118 and the shoulder 120 are configured to receive mounting bolts for mounting a toilet, and are described in further detail herein. It will be appreciated, that the recessed holes 114 may be positioned in close proximity to the slots 118 and the notches 122. The location of the recessed holes 114 relative to the slots 118 and the notches 122 provides strength around the toilet connection points (e.g. pressure points).

The upper end 106 of the body portion 102 may have a larger diameter opening that tapers inwardly and communicates with the bore 111. The upper end 106 may include a stop shoulder adjacent thereto. A recessed knockout 124 may be positioned at an intersection of the inlet opening with the bore 111. The knockout 124 may be connected to the inner body surface 110 by a frangible seam 126 for ease of removal of the knockout 124. The recessed nature of knockout 124 within the body helps prevent accidental damage to or premature removal of the knockout 124 during construction. The knockout 124 is configured to close off the bore 111 to permit pressure testing of the plumping system for leaks and proper connection. The knockout 124 may include various elements to, for example, prevent the knockout 124 from accidentally passing all the way through the bore 111 and to aid in breaking the knockout 124 out of the bore 111. The various elements may include, for example, vertical uprights, indicia to aid in knockout, pipe stops, protrusions, or still other elements to facilitate use of the knockout 124.

Figure 6:
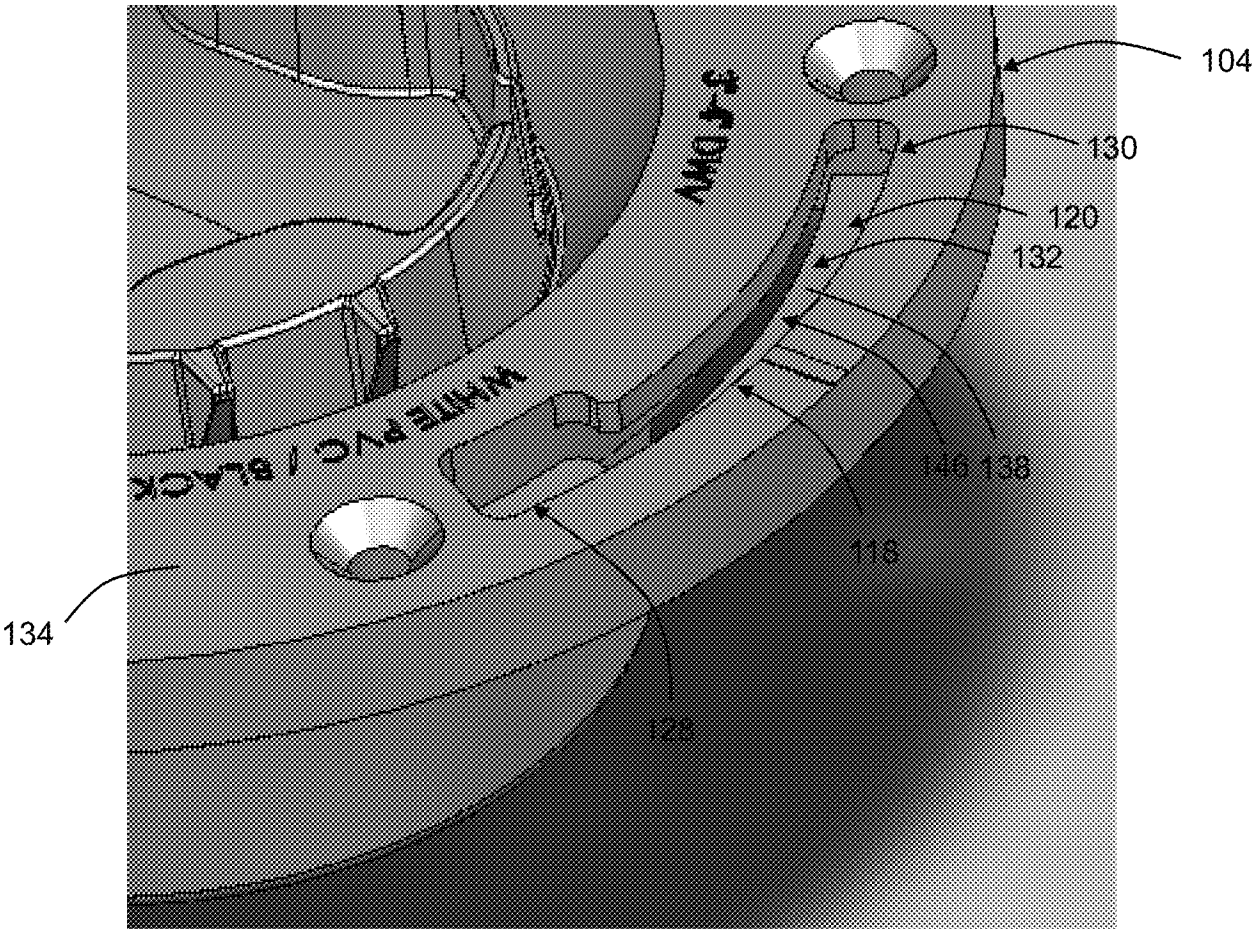
FIG. 6 is a top perspective view of a portion of the closet flange shown in FIG. 1, according to an aspect of this disclosure.

FIG. 6 illustrates a top perspective view of a portion of the closet flange 100 illustrated in FIGS. 1-5. The slots 118 extend along the flange portion 104 from a receiving end 128 to a retaining end 130. The slots 118 have an opening 132 that is defined by an upper surface 134 of the flange portion 104. The opening 132 extends from the receiving end 128 to the retaining end 130. The flange portion 104 has a bottom surface 136 that opposes the upper surface 134. In an aspect, two slots 118 are positioned along the flange portion 104. Alternatively, fewer or more slots 118 may be positioned along the flange portion 104, for example, four slots 118. Each of the slots 118 positioned along the flange portion 104 may be spaced substantially equidistant from each other circumferentially about the flange portion 104. For example, if the flange portion 104 includes two slots 118, each slot 118 may be spaced 180° from the other slot 118 about the flange portion 104. Each slot 118 may include a corresponding shoulder 120 positioned below.

The opening 132 at the receiving end 128 of the slot 118 has a width that is greater than a width of the opening 132 at the retaining end 130 of the slot 118. The greater width at the receiving end 128 allows, for example, a bolt head to be received with the opening 132. The slot 118 extends substantially circumferentially along the flange portion 104 from the receiving end 128 to the retaining end 130. Alternatively, the slot 118 may extend linearly along the flange portion 104 from the receiving end 128 to the retaining end 130. In an aspect, the slot 118 extends in a direction that is substantially perpendicular to a radial direction R extending radially outward from a center of the closet flange 100.

The shoulder 120 includes a support surface 138 and a bottom shoulder surface 140. The support surface 138 is configured to support a bolt thereon such that a shaft of the bolt extends through the opening 132 of the slot 118 when the bolt is positioned on the support surface 138. The shoulder 120 is positioned below the opening 132 of the slot 118 in the axial direction A. The shoulder 120 extends below the opening 132 from the receiving end 128 to the retaining end 130 of the slot 118. In an aspect, the bottom shoulder surface 140 is approximately parallel to the bottom surface 136 of the flange portion 104. In another aspect, the bottom shoulder surface 140 is substantially flush with the bottom surface 136 of the flange portion 104.

Figure 7:
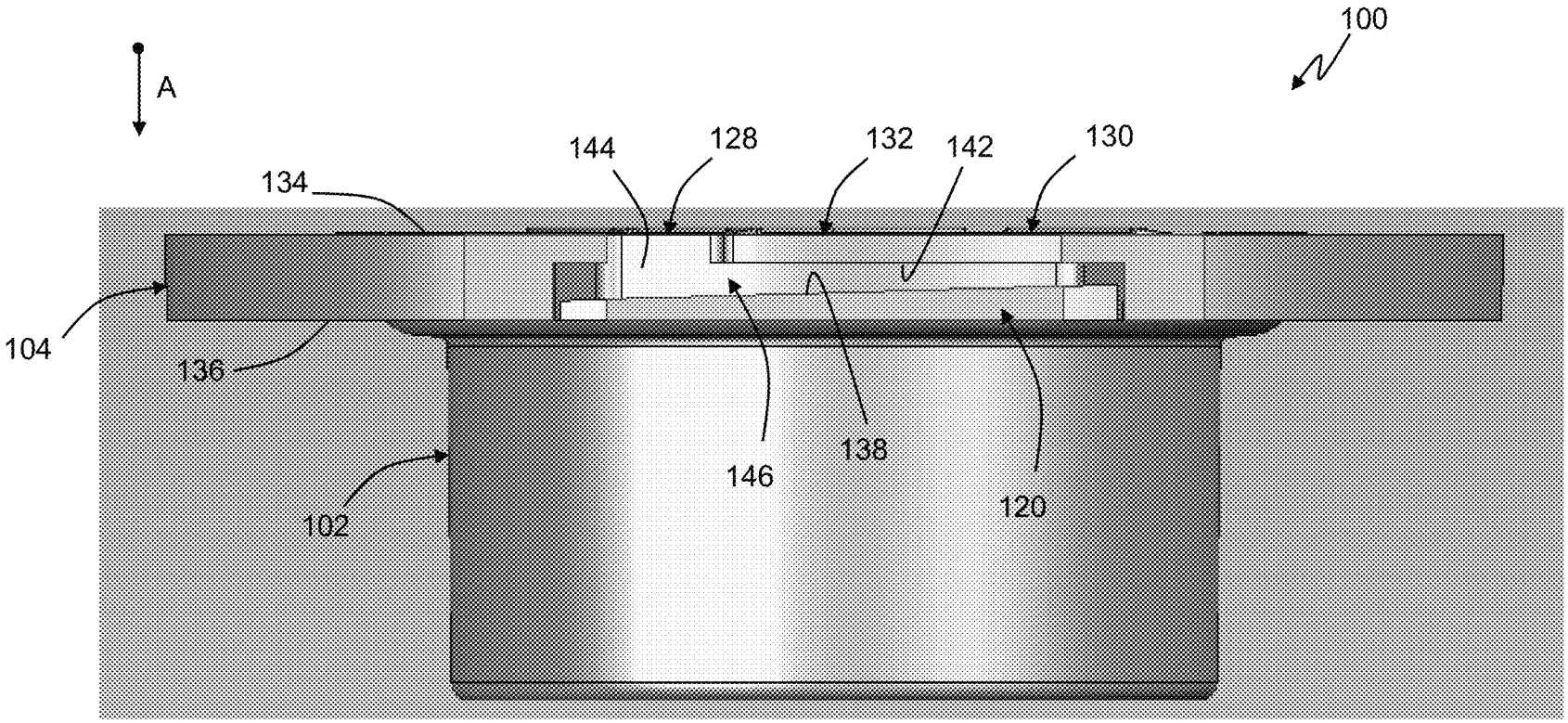
FIG. 7 is a side view of a cross section of the closet flange shown in FIG. 5 taken along line 7-7, according to an aspect of this disclosure.

FIG. 7 illustrates a cross sectional view of the flange portion 104 taken along line 7-7 shown in FIG. 5. The support surface 138 extends in a direction that is offset from a direction the upper surface 134 of the flange portion 104 extends. The upper surface 134 may extend in a direction that is substantially perpendicular to the axial direction A. A distance from the support surface 138 to the opening 132 at the receiving end 128 of the slot 118 in the axial direction A is greater than a distance from the support surface 138 to the opening 132 at the retaining end 130 of the slot 118 in the axial direction A. In an aspect, the support surface 138 extends linearly from the receiving end 128 to the retaining end 130 such that a distance from the support surface 138 to the opening 132 in the axial direction A gets progressively smaller moving along the support surface 138 from the receiving end 128 to the retaining end 130.

The flange portion 104 further includes a lower surface 142, an inner surface 144, and an outer surface (not visible in figures). The outer surface is spaced radially outward from the inner surface 144, and the lower surface 142 opposes the upper surface 134 of the flange portion 104 in the axial direction A. The lower surface 142 and the upper surface 134 may be approximately parallel. The support surface 138 of the shoulder 120 extends at an angle that is offset from the lower surface 142. The support surface 138, the lower surface 142, the inner surface 144, and the outer surface define a channel 146 therebetween. The channel 146 extends below the slot 118 from the receiving end 128 to the retaining end 130. The channel 146 has at least one channel opening 148 (see FIGS. 2 and 4) positioned below the opening 132 of the slot 118. In an aspect, the channel opening 148 extends below the upper surface 134 of the support flange 104 from the receiving end 128 to the retaining end 130 of the opening 132.

The shoulder 120 may be integrally formed with the flange portion 104 such that the shoulder 120 and the flange portion 104 form a single unitary member. In an aspect, the shoulder 120 and the flange portion 104 may be manufactured using, for example, polyvinyl chloride (PVC).

One example of a method for securing the closet flange 100 to a toilet commences by securing the closet flange 100 to the floor or subfloor. Mounting bolts are placed into the recessed holes 114 are secured to the floor to mechanically mount the closet flange 100.

To secure the toilet to the closet flange 100, a bolt head of a bolt is placed into the slot 118 through the opening 132 at the receiving end 128 and onto the support surface 138 of the shoulder 120 such that a shaft of the bolt head extends through the opening 132. The slot 118 is configured to receive bolt heads that have a width that is less than the width of the opening 132 at the receiving end 128. The bolt head is moved along the support surface 138 from the receiving end 128 to the retaining end 130. It will be appreciated that the bolt head may be moved to the retaining end 130 before or after securing the closet flange 100 to the floor or subfloor. The slot 118 is configured to retain bolt heads that have a width that is greater than the width of the opening 132 at the retaining end 130. The angular offset between the support surface 138 and the lower surface 148 of the flange portion 104 causes the distance between the support surface 138 and the lower surface 148 to get progressively smaller as the bolt head moves toward the retaining end 130, thereby creating a tightening force between the support surface 138 and the lower surface 148 onto the bolt head. Once the bolt head is positioned at the retaining end 130, the bolt is secured to the flange portion 104 by the tightening force. In an aspect, the bolt may be substantially secured to the flange portion 104 without the bolt head being fully positioned at the retaining end 130. For example, as the bolt head is being moved from the receiving end 128 toward the retaining end 130 the tightening force may be sufficient to secure the bolt to the flange portion 104 at a position between the receiving end 128 and the retaining end 130.

The shoulder 120 prevents the bolts from falling through the flange portion 104 during installation, and also helps align the bolts with the toilet being installed. Supporting, aligning, and securing the bolt on the shoulder 120 and within the slot 118 minimizes issues related to floors and subfloors that are uneven and/or include cracks, dents, or other irregularities.

After the bolts are secured to the flange portion 104, the toilet may be placed on top of and secured to the closet flange 100 by the shaft of the bolt. Alternatively, or optionally, bolts may be placed within the notches 122 of the flange portion 104 to further secure the toilet to the closet flange 100.

FIGS. 8 through 11 illustrate an alternate aspect of a closet flange 200. Portions of the alternate aspect of the closet flange 200 disclosed in FIGS. 8 through 11 are similar to aspects of the closet flange 100 described above in FIGS. 1 through 7 and those portions function similarly to those described above. Closet flange 200 includes a flange portion 204 and a shoulder 220. The flange portion 204 is securable to an upper end of a body portion (not shown), such that the flange portion 204 extends radially outward and circumferentially about the body portion. In an aspect, the body portion may be configured substantially similarly to the body portion 102 of the closet flange 100 described above. The closet flange 200 may be secured to a floor and to a toilet in a substantially similar manner as the closet flange 100.

The flange portion 204 includes recessed holes 214 and slot 218 (e.g. keyed slots). The recessed holes 214 are configured to receive mounting bolts for mechanically mounting the closet flange 200 to the floor. It will be appreciated that the recessed holes 214 may be positioned in close proximity to the slots 218. The location of the recessed holes 214 relative to the slots 218 provides strength around the toilet connection points (e.g. pressure points).

The slot 218 and the shoulder 220 are configured to receive mounting bolts for mounting a toilet, and are described in further detail herein. In an aspect, two slots 218 are positioned along the flange portion 204. Alternatively, fewer or more slots 218 may be positioned along the flange portion 204, for example, four slots 218. Each of the slots 218 positioned along the flange portion 204 may be spaced substantially equidistant from each other circumferentially about the flange portion 204. Each slot 218 may include a corresponding shoulder 220 positioned below.

Figure 8:
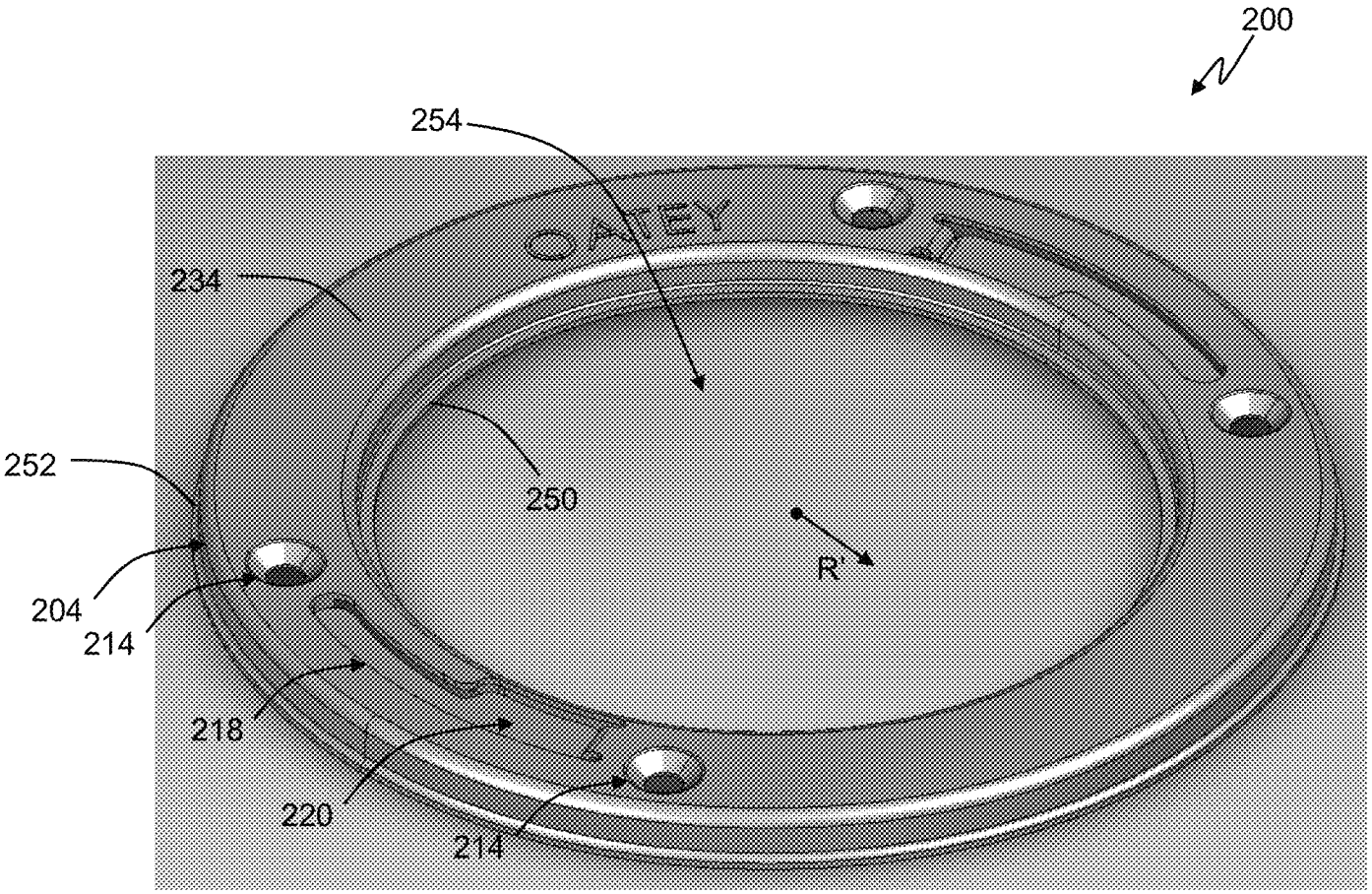
FIG. 8 is a top perspective view of a closet flange, according to a second aspect of this disclosure.
Figure 9:
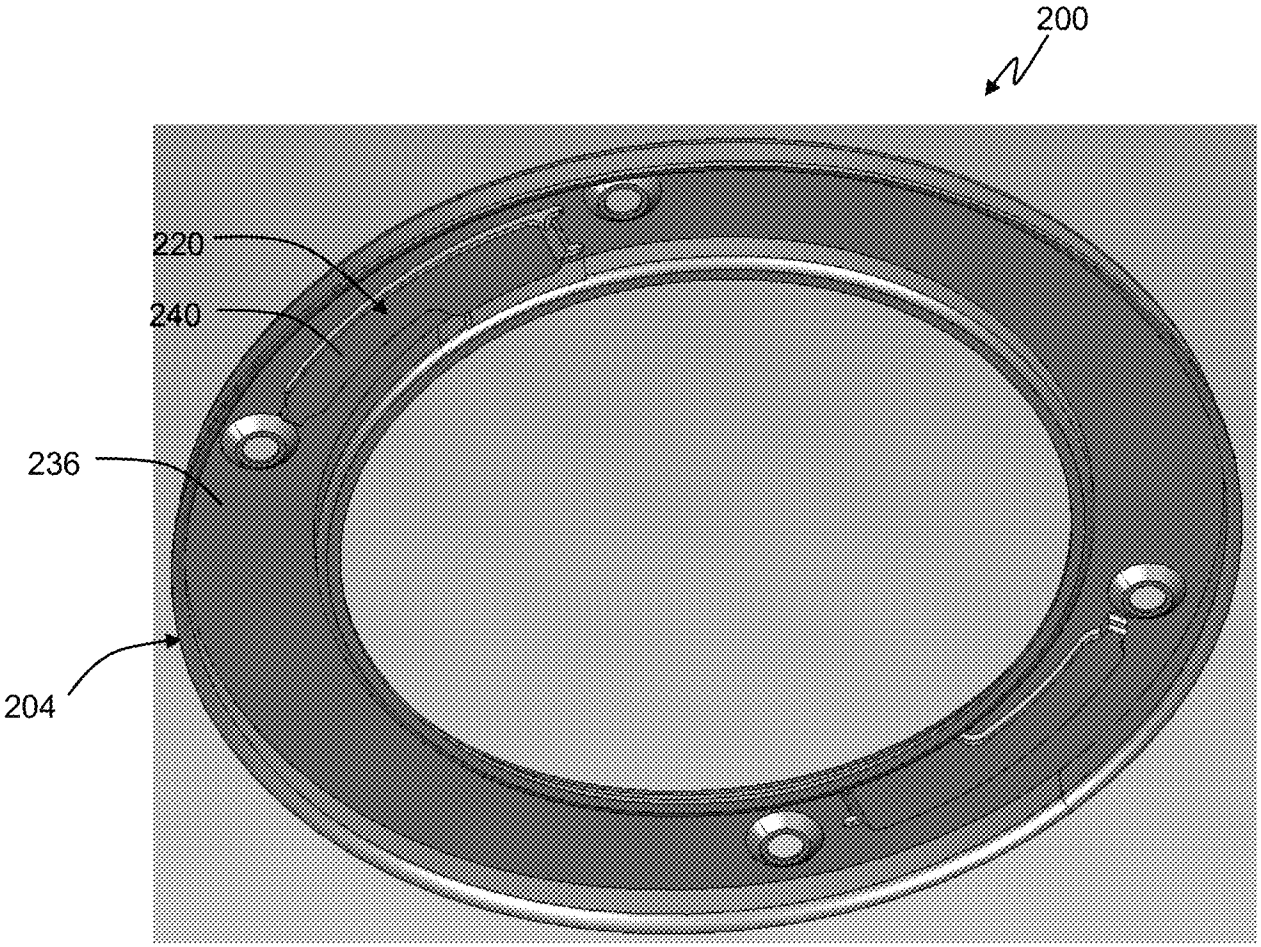
FIG. 9 is a bottom perspective view of the closet flange shown in FIG. 8, according to an aspect of this disclosure.
Figure 10:
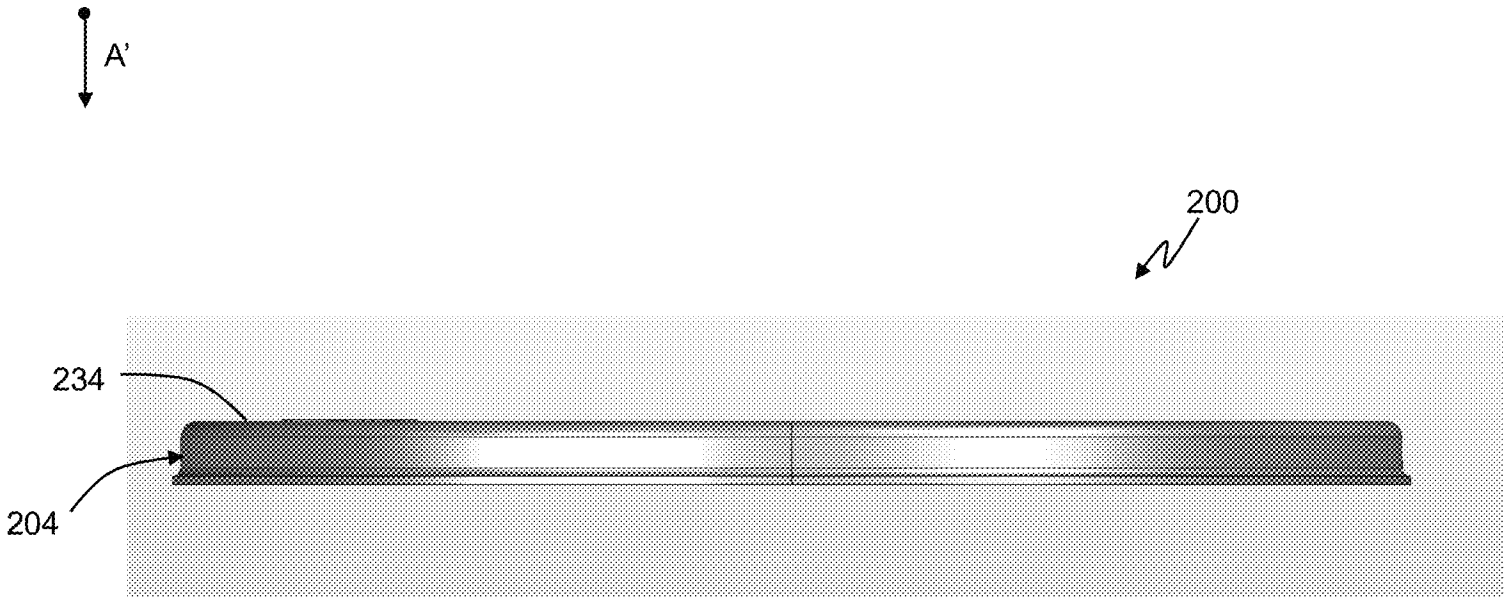
FIG. 10 is a side view of the closet flange shown in FIG. 8, according to an aspect of this disclosure.
Figure 11:
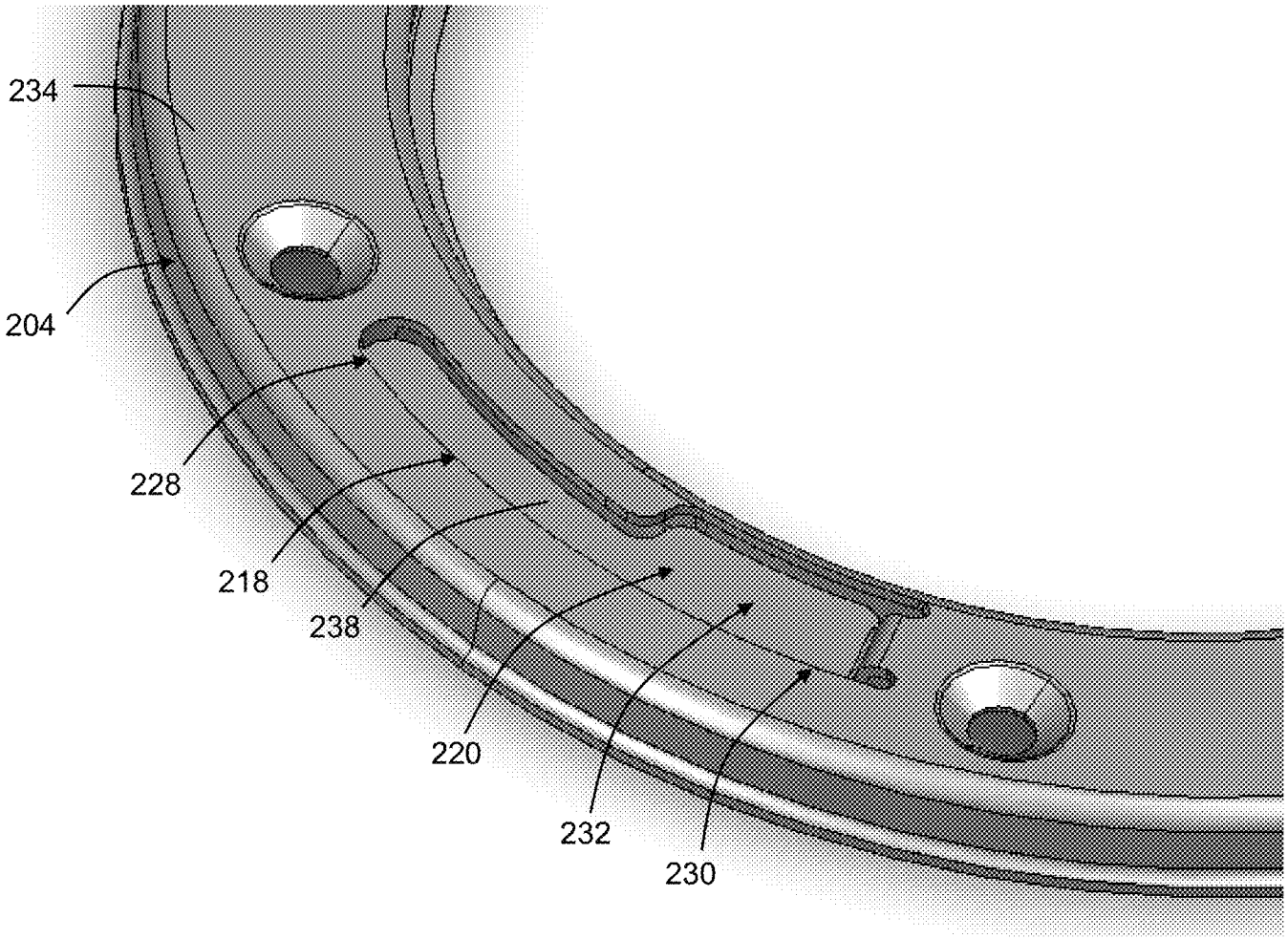
FIG. 11 is a top perspective view of a portion of the closet flange shown in FIG. 8, according to an aspect of this disclosure.

With reference to FIG. 11, which illustrates a top perspective view of a portion of the closet flange 200 illustrated in FIG. 8, the flange portion 204 further includes an upper surface 234, a lower surface 236, an inner edge 250, and an outer edge 252. The lower surface 236 opposes the upper surface 234 in an axial direction A'. The inner edge 250 defines a substantially circular opening 254 through the flange portion 204. The outer edge 252 is spaced apart from the inner edge 250 in a radial direction R'. The radial direction R' is substantially perpendicular to the axial direction A' and extends radially outward from a center of the opening 254. The flange portion 204 extends about the opening 254.

The slot 218 is positioned between the inner edge 250 and the outer edge 252. The slot 218 extends through the flange portion 204 from the upper surface 234 to the lower surface 236. The slot 218 further extends along the flange portion 204 from a receiving end 228 to a retaining end 230. The slot 218 has an opening 232 that is defined by the upper surface 234. The opening 232 extends from the receiving end 228 to the retaining end 230.

The opening 232 at the receiving end 228 of the slot 218 has a width that is greater than a width of the opening 232 at the retaining end 230 of the slot 218. The slot 118 extends in a substantially circumferential direction along the flange portion 204 from the receiving end 228 to the retaining end 230. The circumferential direction is substantially perpendicular to the axial direction A'. Alternatively, the slot 218 may extend linearly along the flange portion 204 from the receiving end 228 to the retaining end 230.

The shoulder 220 is positioned below the slot 218 in the axial direction A', and extends from the receiving end 228 to the retaining end 230. The shoulder 220 may be integrally formed with the flange portion 204 such that the shoulder 220 and the flange portion 204 form a single unitary member. Alternatively, the shoulder 220 may be a separate component that is attached to the flange portion 204 by, for example, welding, soldering, gluing, or other similar techniques. In an aspect, the flange portion 204 and the shoulder 220 comprise a metal.

The shoulder 220 includes a support surface 238 and a bottom shoulder surface 240. The support surface 238 is configured to support a bolt thereon such that a shaft of the bolt extends through the opening 232 of the slot 218 when the bolt is positioned on the support surface 238. The shoulder 220 extends below the opening 232 from the receiving end 228 to the retaining end 230 of the slot 218. In an aspect, the support surface 238 is approximately parallel to the lower surface 236 of the flange portion 204. The bottom shoulder surface 240 may be approximately parallel to the lower surface 236 of the flange portion 204. In an aspect, the bottom shoulder surface 240 is below the lower surface 236 of the flange portion 204 in the axial direction A'.

The shoulder 220 is configured to be flexible in the axial direction A'. For example, when a force is applied to the support surface 238, the shoulder 220 may flex or otherwise be displaced in the axial direction A' relative to the lower surface 236 of the flange portion 204. The flexible configuration of the shoulder 220 provides a securing force to a bolt head positioned on the shoulder 220 and moved to the retaining end 230 of the slot 218. The flexible configuration also allows for various sized bolt heads to be positioned with the slot 218.

One example of a method for securing the closet flange 200 to a toilet commences by securing the closet flange 200 to the floor or subfloor. Mounting bolts are placed into the recessed holes 214 and are secured to the floor to mechanically mount the closet flange 200. A bolt head of a bolt is placed into the slot 218 through the opening 232 at the receiving end 228 and onto the support surface 238 of the shoulder 220 such that a shaft of the bolt head extends through the opening 232. The bolt head is moved along the support surface 238 from the receiving end 228 to the retaining end 230.

During the movement of the bolt head from the receiving end 228 to the retaining end 230, the shoulder 220 flexes in the axial direction A' away from the slot 218. As the shoulder 220 flexes, the shoulder 220 applies a force to the bolt head in a direction toward the slot 218 (e.g. opposite to the axial direction A'). The force applied by the shoulder 220 to the bolt head secures the bolt head between the support surface 238 and the lower surface 236 of the flange portion 204. Once the bolt head is positioned at the retaining end 230, the bolt is secured to the flange portion 204 by the force applied to the bolt head by the shoulder 220. In an aspect, the bolt may be substantially secured to the flange portion 204 without the bolt head being fully positioned at the retaining end 230. For example, as the bolt head is being moved from the receiving end 228 toward the retaining end 230 the force applied to the bolt head by the shoulder 220 may be sufficient to secure the bolt to the flange portion 204 at a position between the receiving end 228 and the retaining end 230. After the bolt is secured to the flange portion 204, the toilet may be placed on top of and secured to the closet flange 200 by the shaft of the bolt.

The flange portions 104 and 204 and the corresponding shoulders 120 and 220 may be used in a variety of manners, including, but not limited to, securing drain pipes, tubes, conduits, or other fluid communication components together.

It will be appreciated that the foregoing description provides examples of the disclosed system and method. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

What is claimed is:

1. A closet flange comprising:

a body portion having an upper end and a lower end spaced apart from the upper end; and a flange portion extending radially outward from the upper end of the body portion, the flange portion comprising:

at least one slot extending along the flange portion from a receiving end to a retaining end, the at least one slot having an opening defined by an upper surface of the flange portion, the opening extending from the receiving end to the retaining end, and a shoulder positioned below the opening of the at least one slot, the shoulder extending below the opening of the at least one slot from the receiving end to the retaining end, wherein the shoulder includes a support surface configured to support a bolt thereon such that a shaft of the bolt extends through the opening of the at least one slot when the bolt is on the support surface, the support surface extending at an angle offset from the upper surface of the flange portion, such that a distance from the support surface to the opening at the receiving end of the at least one slot is greater than a distance from the support surface to the opening at the retaining end of the at least one slot.

2. The closet flange of claim 1, wherein the flange portion includes a bottom flange surface, and wherein the shoulder includes a bottom shoulder surface that is approximately parallel to the bottom flange surface of the flange portion.

3. The closet flange of claim 1, wherein the flange portion includes a lower surface opposing the upper surface, an inner surface, and an outer surface spaced radially outward from the inner surface, the support surface extending at an angle offset from the lower surface of the flange portion, wherein the support surface, the lower surface, the inner surface, and the outer surface define a channel therebetween extending below the opening of the at least one slot from the receiving end to the retaining end, the channel having a channel opening located below the opening of the at least one slot.

4. The close flange of claim 1, wherein the shoulder is integrally formed with the flange portion such that the shoulder and flange portion form a single unitary member.

5. The closet flange of claim 4, wherein the body portion is integrally formed with the flange portion such that the body portion and the flange portion form a single unitary member.

6. The closet flange of claim 1, wherein the body portion contains a bore and the flange portion contains an inlet opening in fluid communication with the bore, the closet flange further comprising:

a knockout recessed within the body portion configured to close off the bore, the knockout having a frangible connection with an interior wall of the bore to permit the knockout to be broken out of the bore.

7. The closet flange of claim 1, wherein a width of the opening at the receiving end is greater than a width of the opening at the retaining end.

8. The closet flange of claim 1, wherein the at least one slot extends circumferentially along the flange portion from the receiving end to the retaining end.

9. A method for securing the closet flange of claim 1 to a toilet, the method comprising:

securing the closet flange to a subfloor;

inserting a bolt head through the opening of the at least one slot at the receiving end such that the shaft of the bolt head extends through the opening of the at least one slot at the receiving end and the bolt head is supported by the support surface of the shoulder;

moving the bolt head from the receiving end of the at least one slot to the retaining end of the at least one slot such that the shaft extends through the opening of the at least one slot at the retaining end; and securing the toilet to the shaft of the bolt head.

10. The method of claim 9, wherein the shoulder is flexible, wherein during the step of moving the bolt head from the receiving end to the retaining end the shoulder flexes in a direction away from the at least one slot and applies a force to the bolt head in a direction toward the at least one slot such that the bolt head is secured between a lower surface of the flange portion and the support surface of the shoulder.

11. A closet flange comprising:

a flange portion defining a substantially circular flange opening, the flange portion including an upper surface, a lower surface opposing the upper surface in an axial direction, at least one slot, an inner edge defining the flange opening, and an outer edge spaced apart from the inner edge in a radial direction, the radial direction being substantially perpendicular to the axial direction, the at least one slot being positioned between the inner edge and the outer edge in the radial direction, the at least one slot extending through the flange portion from a slot opening defined by the upper surface to the lower surface, the at least one slot further extending along the flange portion from a receiving end to a retaining end; and a shoulder including a support surface positioned below the slot opening of the at least one slot in the axial direction, the shoulder extending below the slot opening from the receiving end to the retaining end, wherein the support surface is configured to support a bolt head thereon such that a shaft of the bolt head extends through the at least one slot, the shoulder being flexible in the axial direction, wherein when the bolt head is inserted into the receiving end of the at least one slot and moved toward the retaining end the shoulder flexes in the axial direction and applies a force to the bolt head in a direction opposite the axial direction toward the at least one slot that secures the bolt head between the support surface of the shoulder and the lower surface of the flange portion.

12. The closet flange of claim 11, wherein the shoulder is integrally formed with the flange portion such that the shoulder and flange portion form a single unitary member.

13. The closet flange of claim 12, wherein the flange portion and the shoulder comprise a metal.

14. The closet flange of claim 11, wherein a width of the receiving end of the at least one slot is greater than a width of the retaining end of the at least one slot.

15. The closet flange of claim 11, wherein the support surface is substantially parallel to the lower surface of the flange portion.

16. The closet flange of claim 11, wherein the retaining end is spaced apart from the receiving end in a direction that extends substantially circumferentially about the flange opening, the circumferential direction being substantially perpendicular to the axial direction.

17. The closet flange of claim 11, further comprising a body portion having an upper end and a lower end spaced apart from the upper end, wherein the flange portion is secured to the upper end of the body portion.

* * * * *